US011659320B2

(12) United States Patent
Peace, Jr.

(10) Patent No.: US 11,659,320 B2
(45) **Date of Patent: *May 23, 2023**

(54) METHOD OF DEPRESSURIZING CROSS RADIATION USING AN ACOUSTICALLY RESISTIVE LEAK PATH

(71) Applicant: Biamp Systems, LLC, Beaverton, OR (US)

(72) Inventor: Paul W. Peace, Jr., Springfield, PA (US)

(73) Assignee: Biamp Systems, LLC, Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/534,344

(22) Filed: Nov. 23, 2021

(65) Prior Publication Data

US 2022/0086563 A1 Mar. 17, 2022

Related U.S. Application Data

(63) Continuation of application No. 16/899,482, filed on Jun. 11, 2020, now Pat. No. 11,184,701.

(60) Provisional application No. 62/860,051, filed on Jun. 11, 2019.

(51) Int. Cl.

| | |
|---|---|
| ***H04R 1/30*** | (2006.01) |
| ***H04R 1/02*** | (2006.01) |
| ***H04R 1/24*** | (2006.01) |

(52) U.S. Cl.
CPC ..... *H04R 1/30* (2013.01); *H04R 1/025* (2013.01); *H04R 1/24* (2013.01)

(58) Field of Classification Search
CPC ..... H04R 1/30; H04R 1/025; H04R 1/24
USPC ..... 381/342
See application file for complete search history.

(56) References Cited

U.S. PATENT DOCUMENTS

| | | | |
|---|---|---|---|
| 4,314,620 | A | 2/1982 | Gollehon |
| 2004/0005069 | A1 | 1/2004 | Buck |
| 2006/0285712 | A1 | 12/2006 | Butler |
| 2008/0247595 | A1 | 10/2008 | Henry |
| 2015/0382090 | A1 | 12/2015 | Bisset et al. |
| 2016/0073195 | A1 | 3/2016 | Adamson et al. |
| 2018/0359559 | A1 | 12/2018 | Bisset et al. |

*Primary Examiner* — Sean H Nguyen

(57) ABSTRACT

A method that improves the energy distribution from a multi-way loudspeaker into free space. The method reduces MF energy through the use of small depressurizing slit openings down the inner half of the HF stems. The openings are sized to be large enough to present a leak path for the secondary energy to migrate out of the stem with no return path.

6 Claims, 18 Drawing Sheets

INTERIOR DETAIL VIEW- HF progressive wave directional arrows shown

INTERIOR DETAIL VIEW- MF progressive wave directional arrows shown

MF PATH WITHOUT SLIT

MF PATH WITH SLIT

INTERIOR DETAIL VIEW- slit shown down stem wall closest to HF entry

Impulse Response of MF, no leak path

Impulse Response of MF, with leak path

Frequency Response of MF, no leak path (BLUE), with leak path (RED)

Frequency Response of HF, no leak path (RED), with leak path (PURPLE)

INTERIOR DETAIL VIEW- leak openings are backed by open cell foam

INTERIOR SECTION VIEW- shown with full enclosing housing

METHOD OF DEPRESSURIZING CROSS RADIATION USING AN ACOUSTICALLY RESISTIVE LEAK PATH

TECHNICAL FIELD

The present invention relates generally to loudspeakers and, more specifically, to a means for improving the energy distribution of the sound waves from loudspeakers into free space.

BACKGROUND

Multiple-frequency (usually referred to as "multi-way") loudspeakers are well-known in the art. The term "multi-way" indicates that the loudspeaker has more than one transducer—each transducer covering different audio frequency ranges. (The term "transducer" is generally synonymous with the terms "speaker," or "driver.") Even non-experts are familiar with two-way and three-way speakers which can be found in loudspeakers designed for the home or automobile.

A typical three-way loudspeaker indicates that the loudspeaker includes a high-frequency transducer, a mid-range transducer, and a low-frequency transducer.

The Background Section of U.S. Pat. No. 8,607,922 provides some information on the state of the art of multi-way loudspeakers. U.S. Pat. No. 8,607,922 is incorporated by reference as if fully set forth herein.

Professional loudspeakers are required to control their energy distribution into free space. The industry term for this is "directivity control" and is an important metric for a successful loudspeaker for large and difficult acoustic spaces or venues. Horns are an effective mechanism in achieving good directivity behavior. Horn loudspeakers use a specially designed waveguide in front of or behind the driver to increase the directivity of the loudspeaker. (In addition, horns transform a small diameter, high pressure condition at the cone surface of the transducer to a large diameter, low pressure condition at the mouth of the horn. This improves the acoustic-electro/mechanical impedance match between the transducer and ambient air, increasing efficiency, and focusing the sound over a narrower area.)

For numerous reasons (size constraints and acoustic origin correlation being two of the most important) coupling high, mid range and low frequency transducer elements to energize a single horn body is a strong design motivator. This allows wave development from all independent transducers to merge within the horn itself and radiate energy with consistent wave front shapes over a large bandwidth.

Coupling a multitude of individual transducers and merging their individual output energies into one cohesive wave front is an important design goal when high output and directivity control are required. The summation of these individual waves occurs in free space for most loudspeakers in what is considered the far field of the device. In this case, the timing relationship between transducers becomes a function of angle from the loudspeaker central "axis." Timing inconsistencies directly relate to summation distortion, thus contaminating directivity behavior.

Loudspeaker designs that merge the individual waves in the near field largely abates this issue. The mechanisms to achieve this requires intricate passageways for the individual energies to strategically merge together. The industry calls these mechanisms "manifolds" and they are typically coupled to a horn body. The present design example is illustrated in FIG. 1.

Many examples similar to the design example are within the prior art. This approach has several design obstacles and limitations, including:

1) The different transducers take up their own individual space and must therefore energize the horn and manifold structure from different local positions. This can lead to timing (i.e., phase) issues between each individual wave front which can negatively alter the summation.

2) The source openings into the horn or manifold from the different transducers create perturbations and acoustic "side" chambers for the neighboring elements. This creates secondary energy paths that include chamber resonances and trailing energy which, over time, creates interference distortion.

3) Transducers that must be positioned in horn or manifold mid-path entry points will naturally create a forward and rearward progressive wave leading to multiple paths for the same source. Similar to the secondary path energy stated in #2 above, the secondary energy results in interference distortion.

4) Certain design geometries create standing wave behavior within the manifold and/or horn body that also leads to distortion in the form of interference behavior and resonant tones.

SUMMARY

The present invention is a method of depressurizing cross radiation using an acoustically resistive leak path. The method is employed in a loudspeaker that houses multiple transducers driving a single unified horn. A three-way loudspeaker will include transducers covering three distinct frequency ranges. In a typical set-up, high frequency (HF) transducers will cover the 2 kHz-20 kHz range, mid-frequency (MF) transducers cover the 500 Hz-2 kHz range, and low frequency (LF) transducers cover the 50 Hz-500 Hz range. The choice of multiple sized transducers is well known in the art and elates to optimizing radiation efficiency and performance criteria.

The present invention is a method of reducing MF energy through the use of small depressurizing slit openings down the inner half of the HF stems. The openings are sized to be large enough to present a leak path for the secondary energy to migrate out of the stem greatly minimizing any return path energy.

It is the goal of this invention to emphasize, reiterate and claim, an invention that teaches and includes a novel method of depressurizing cross radiation using an acoustically resistive leak path.

BRIEF DESCRIPTION OF THE DRAWINGS

The foregoing summary, as well as the following detailed description, may be better understood when read in conjunction with the accompanying drawings, which are incorporated in and form a part of the specification. The drawings serve to explain the principles of the invention and illustrate embodiments of the present invention that are preferred at the time the application was filed. It should be understood however that the invention is not limited to the precise arrangements and instrumentalities shown.

DETAILED DESCRIPTION

Figure 1:
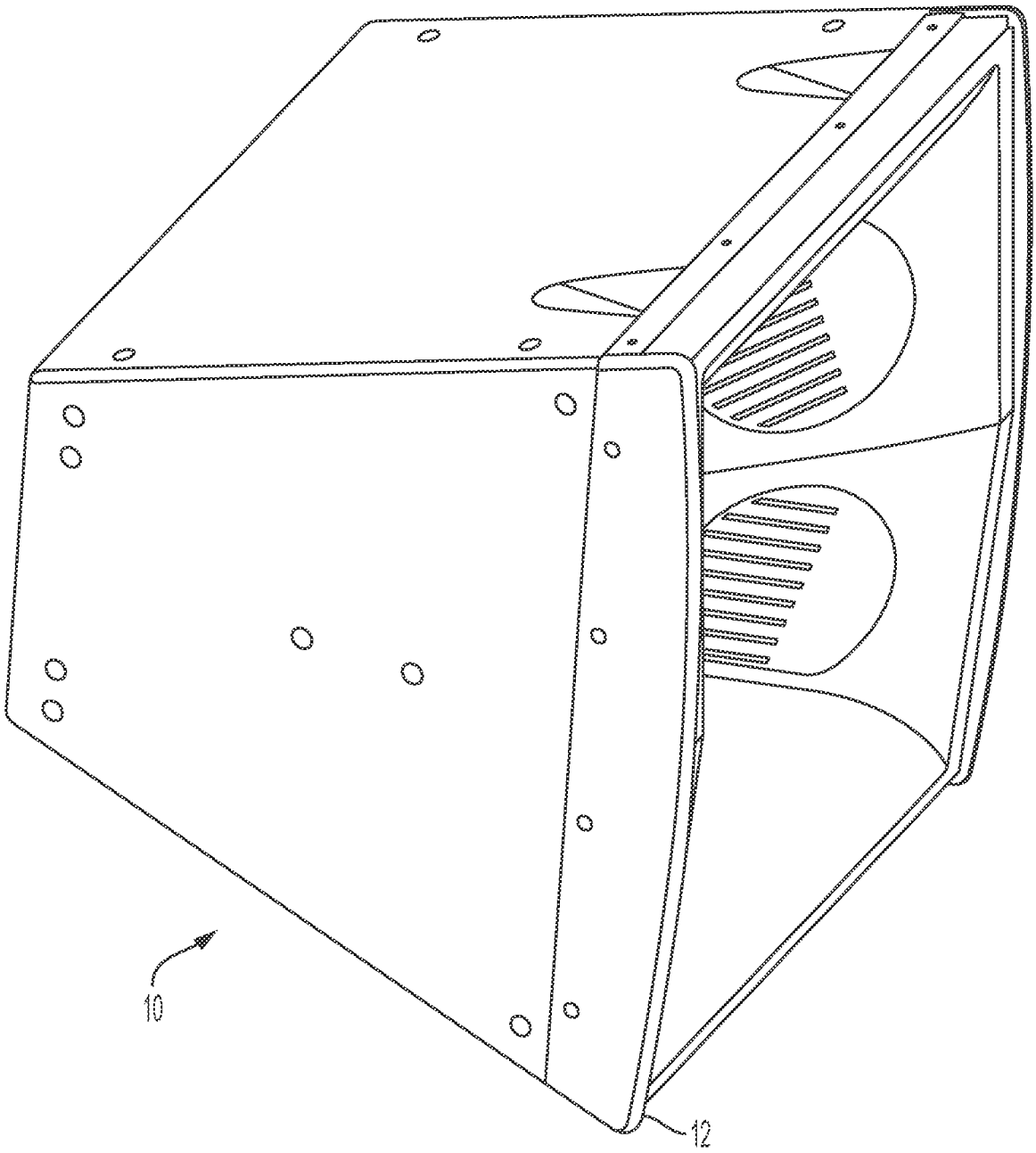
FIG. 1 is perspective (exterior) view of a typical three-way horn loudspeaker.

The present invention will be described in connection with a three-way horn loudspeaker 10 as illustrated in FIG. 1. The present invention may be used in connection with other combinations but, as will be recognized by one skilled in the art, the horn 10 preferably includes a MF and HF transducers.

Figure 2:
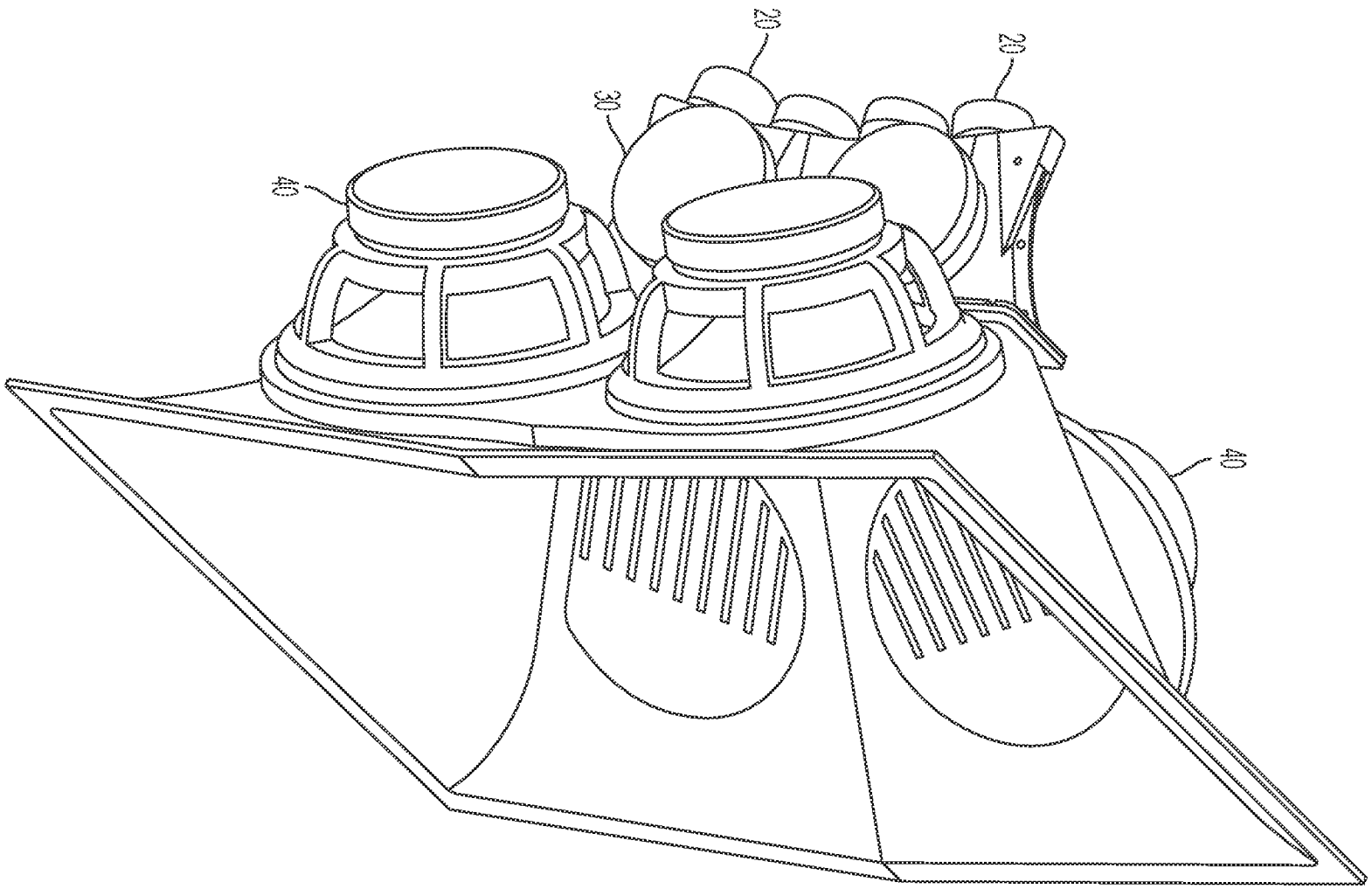
FIG. 2 is an interior perspective view of the three-way loudspeaker shown in FIG. 1.
Figure 3A:
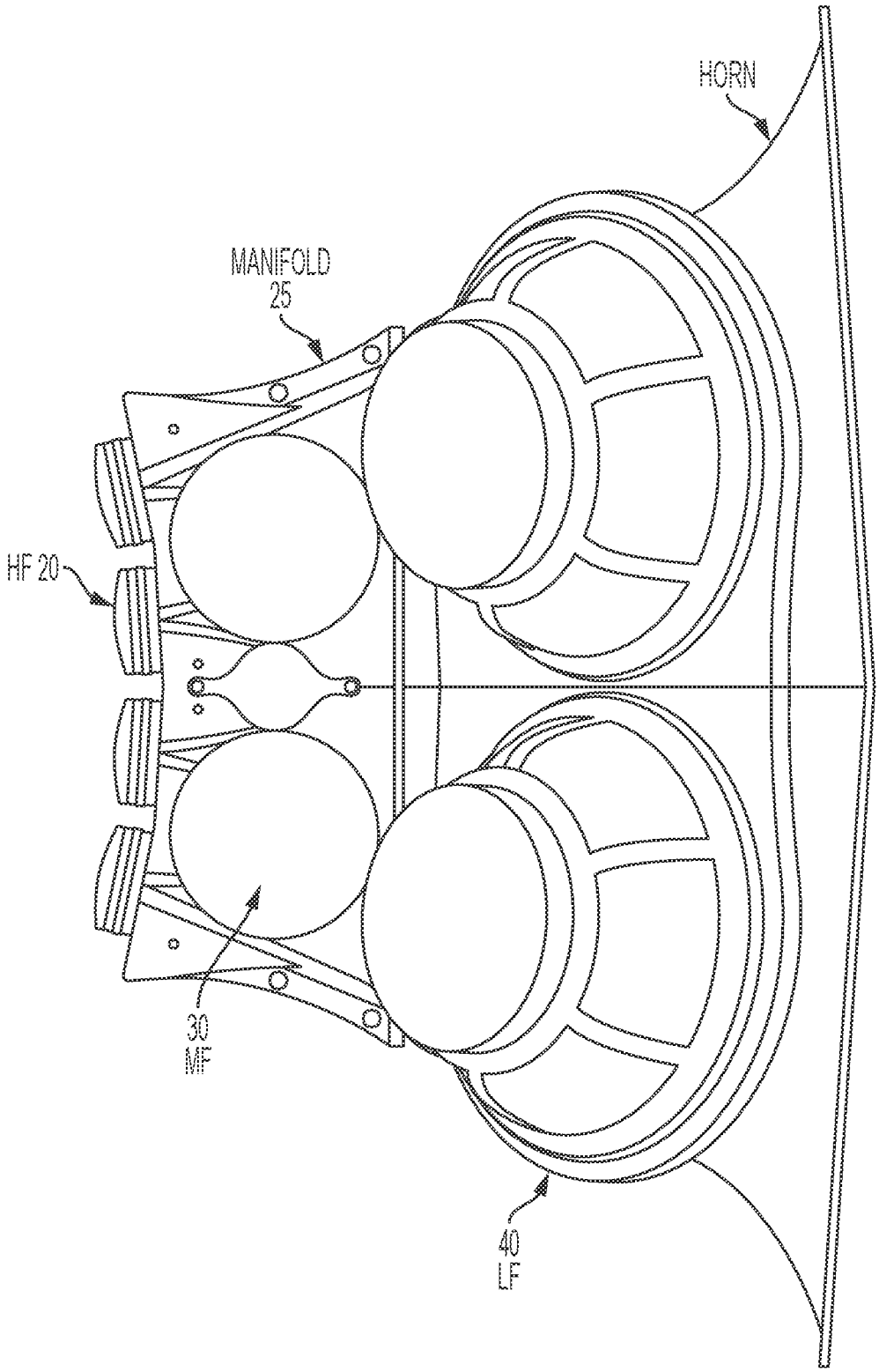
FIGS. 3A-B are an interior sectional views of the three-way loudspeaker shown in FIG. 2.
Figure 3B:
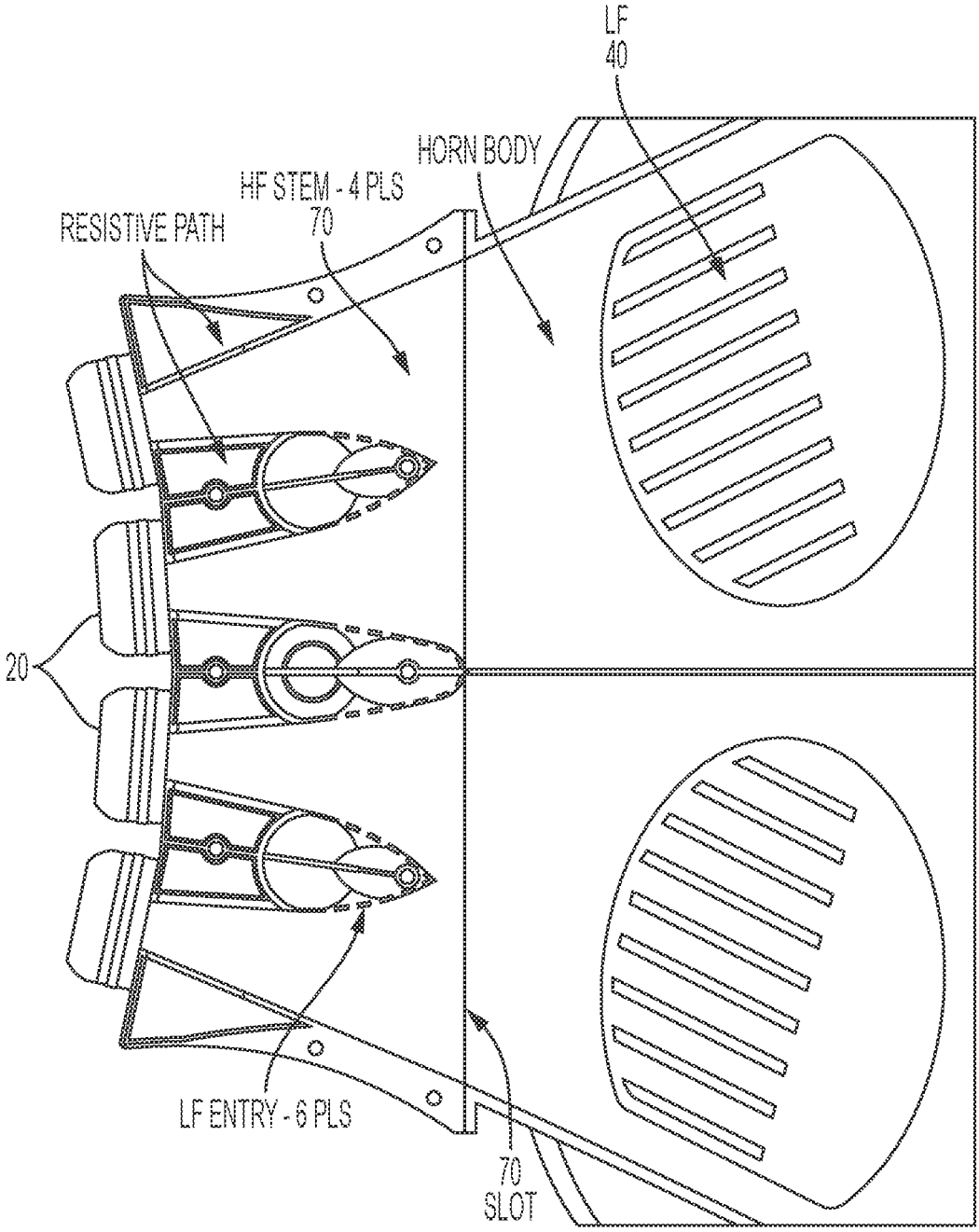

Referring now to FIG. 2, the horn loudspeaker 10 of FIG. 1 is illustrated without the outer enclosure 12. For the purposes of this disclosure, the horn 10 is a three-way loudspeaker including high frequency (HF) transducers 20, mid-frequency (MF) transducers 30, and low frequency (LF) transducers 40. As mentioned previously, the choice of multiple sized transducers is well known in the art and relates to optimizing radiation efficiency and performance criteria such as linearity, transient behavior, low distortion, etc.

The present invention is constrained by the design obstacles delineated previously. In producing a loudspeaker to overcome these design obstacles, several key design choices are made including:

A) Using small transducers to allow for a tight spacing of elements and reducing the size of the overall entry points of the acoustical sources. The HF transducers 20 utilized are ring radiator types with a relatively small physical footprint and an acoustical driving surface which surrounds the horn entry and excites the entry radially.

B) Creating a vertical alignment manifold 25 for the HF 20 and MF 30 transducers to allow for the development of a horn body with rectangular slots 70 as the entry points. This improves the overall performance of the horn, particularly directivity control in the horizontal plane, and allows the manifold to maintain one major dimension smaller than all operational wavelengths (0.7"). See FIGS. 4A-4B and 5A-5C for the location of the slots 70.

C) Referring now to FIGS. 3B, 4A-4B and 5A-5C, placing the LF transducers 40 in the horn body, away from the HF/MF manifold 25. The small size of the HF/MF horn entry slot 70 presents a large acoustic impedance to the LF energy minimizing its ability to migrate into the manifold 25. Also, the orientation of the LF transducers 40 mid-path in the horn body does create secondary path energy, but the dimensions are small in comparison to most operational frequencies for the LF, and therefore nearly all interference is constructive.

Figure 4A:
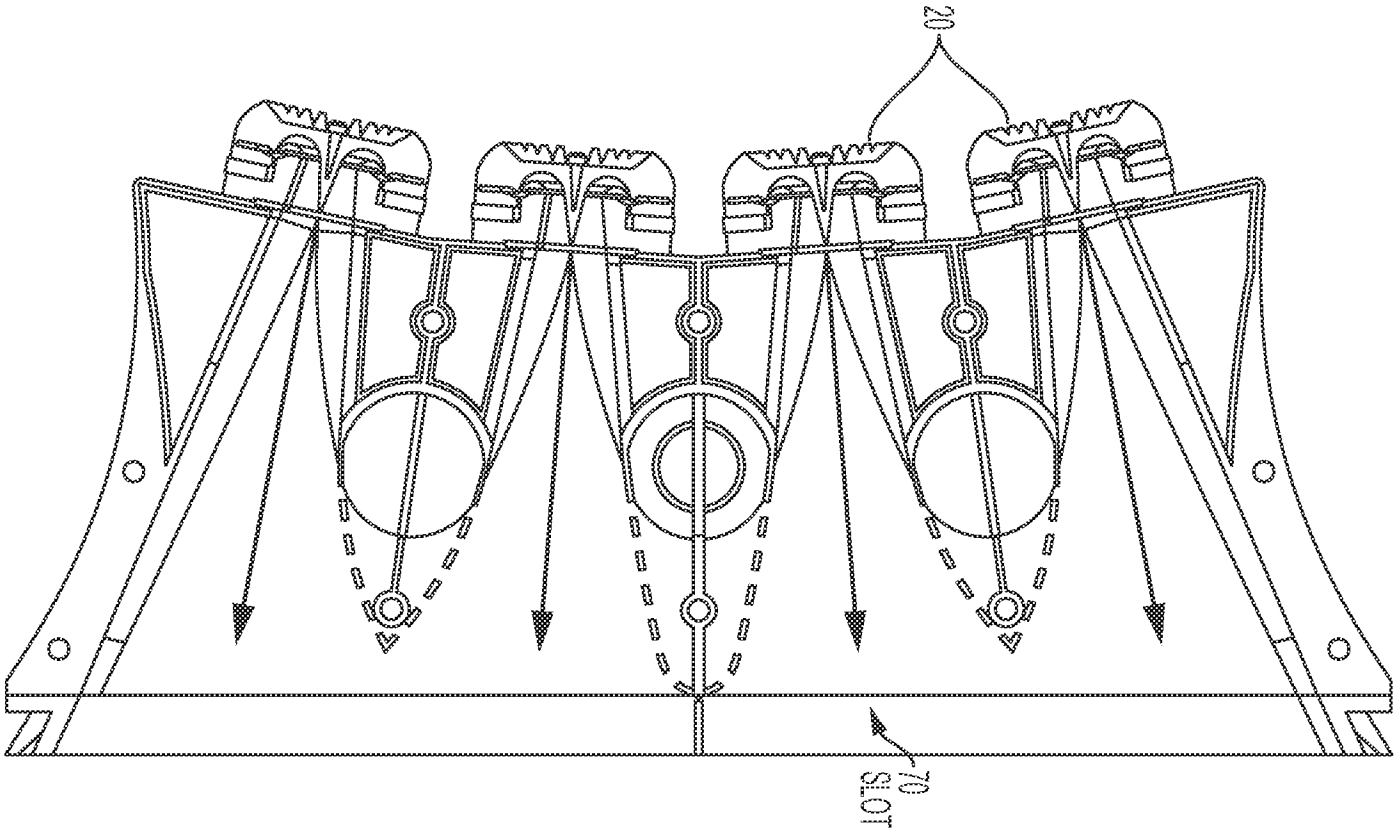
FIGS. 4A-B are interior detail views of the three-way loudspeaker shown in FIG. 1 with directional arrows illustrating the HF progressive waves.
Figure 4B:
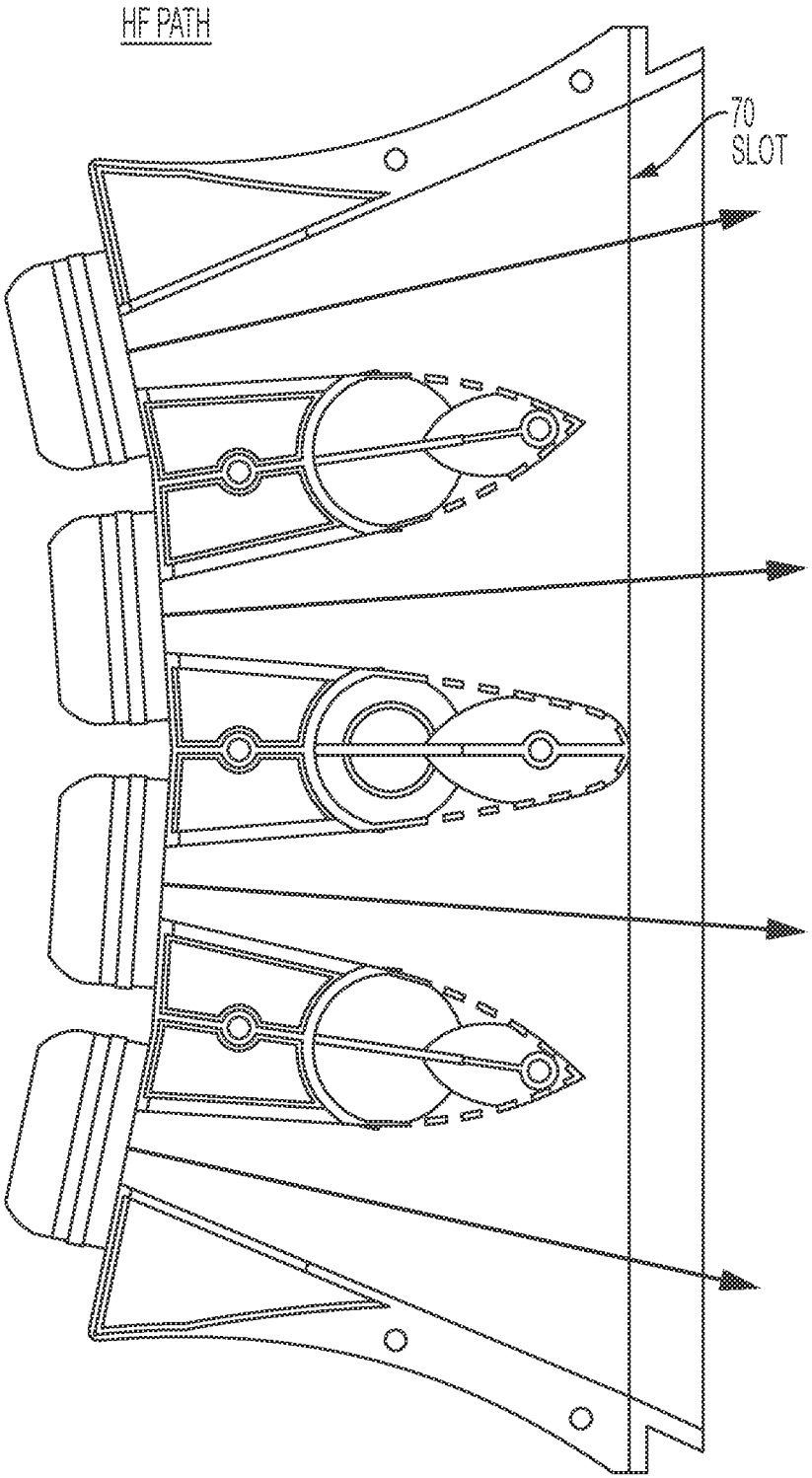
Figure 5A:
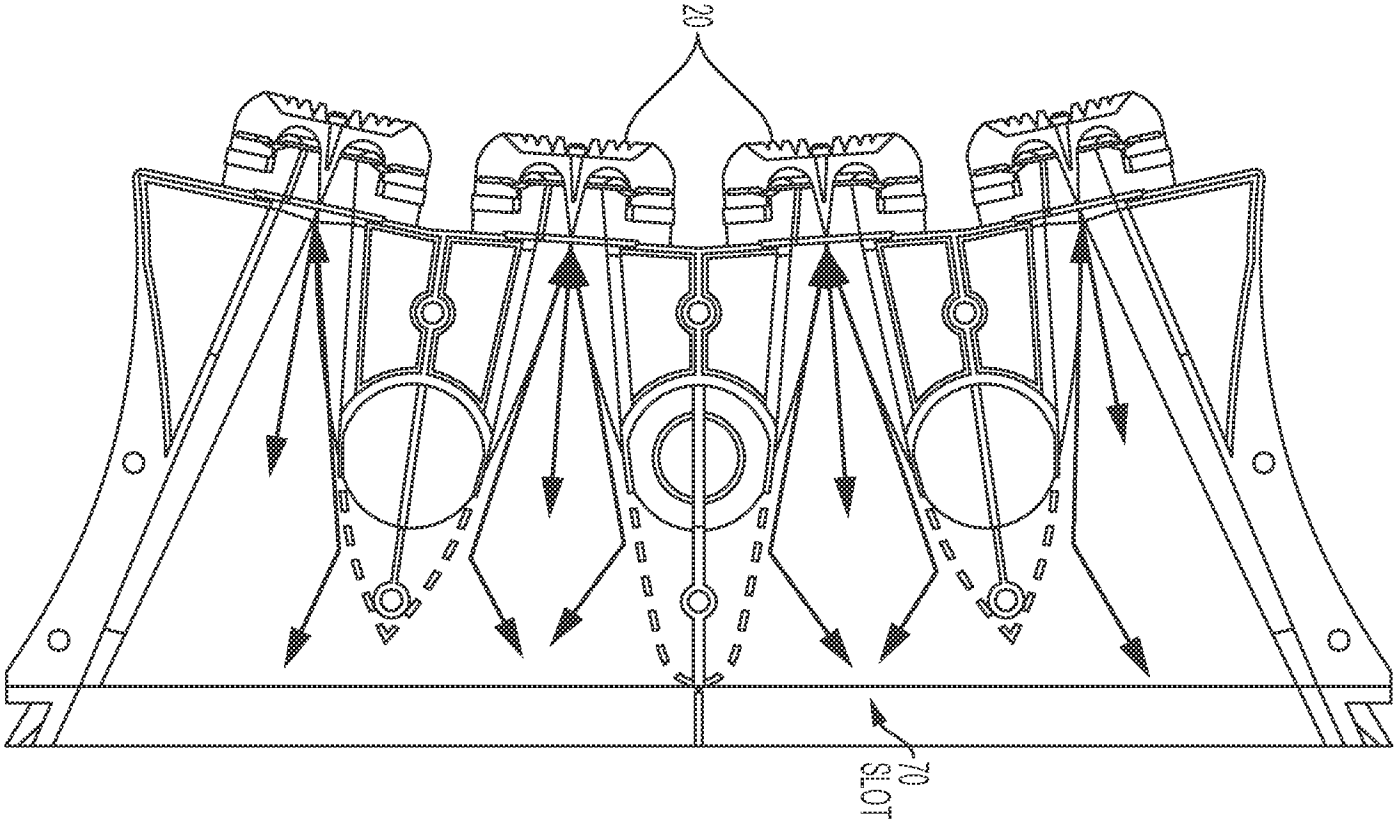
FIGS. 5A-C are interior detail views of the three-way loudspeaker shown in FIG. 1 with directional arrows illustrating the MF progressive waves.
Figure 5B:
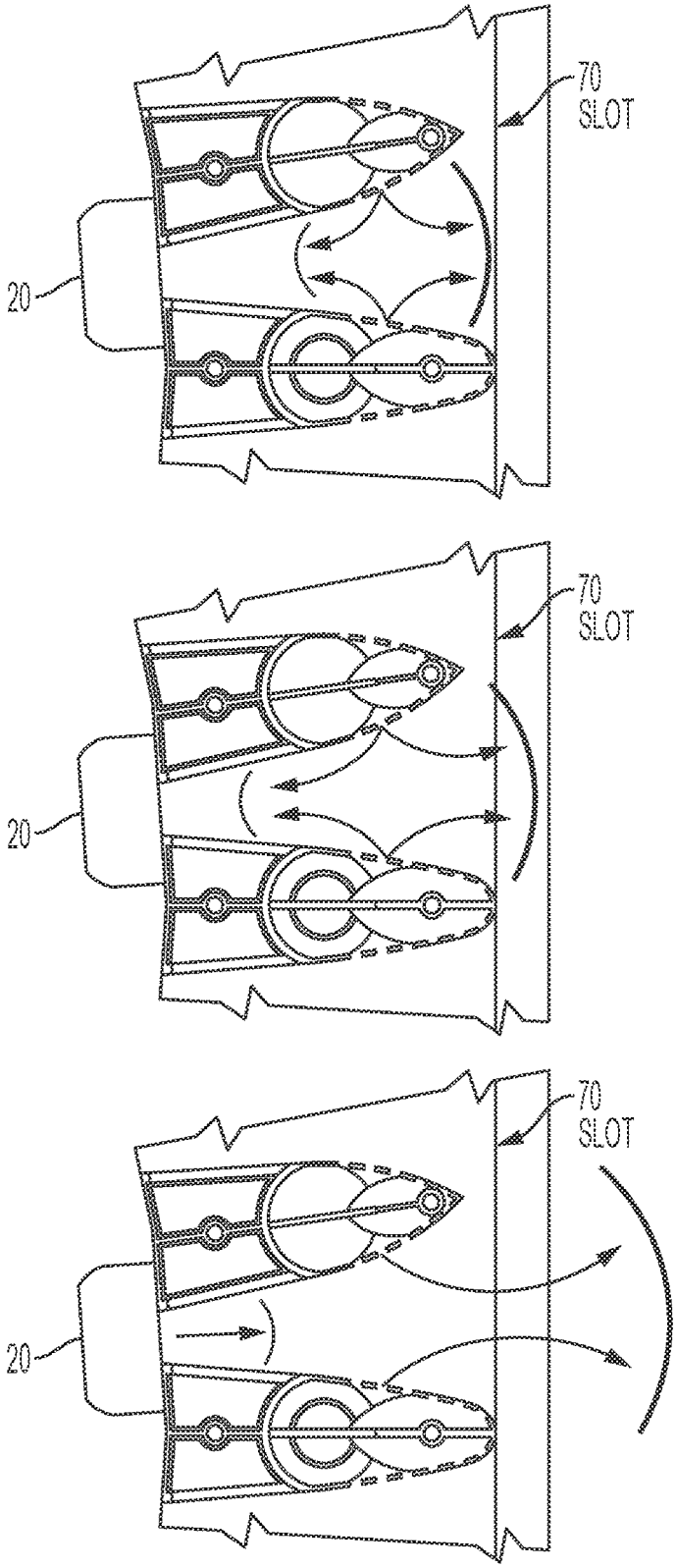
Figure 5C:
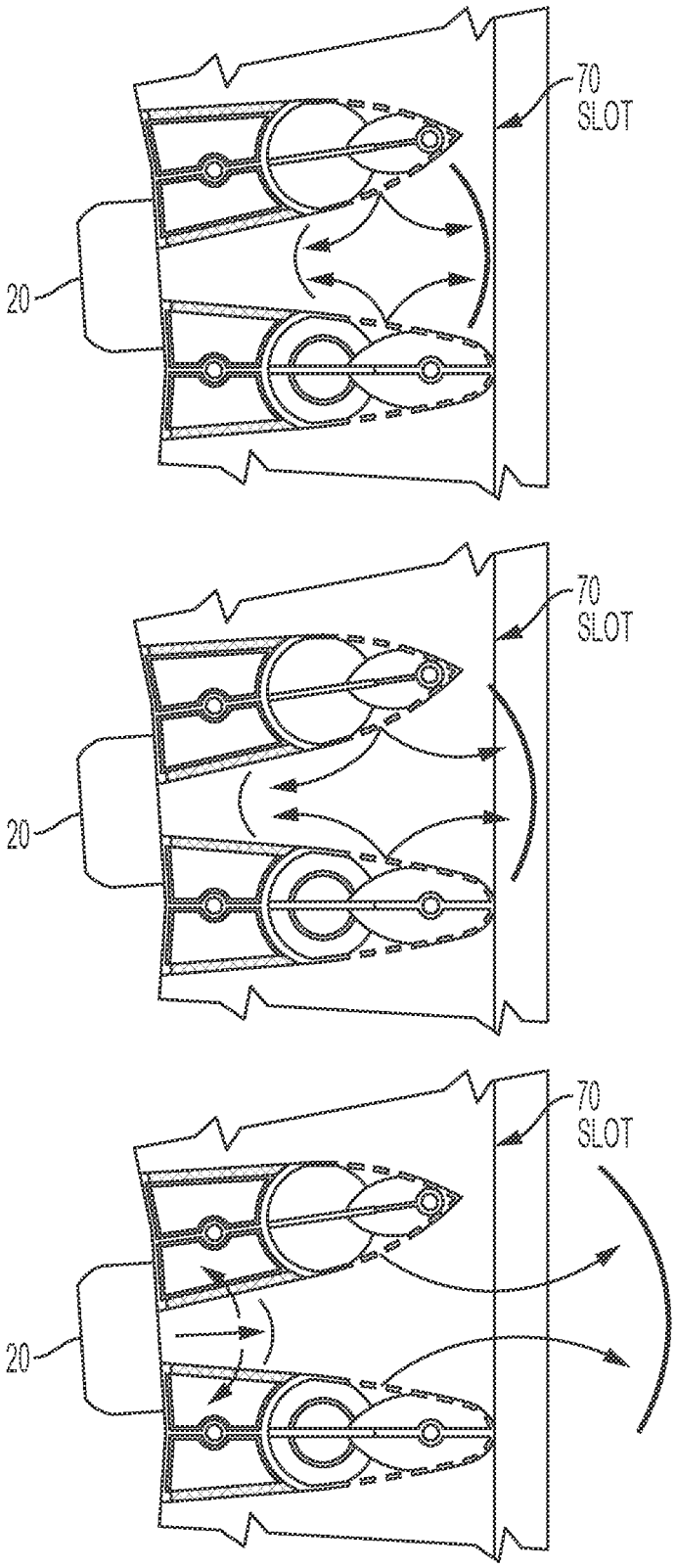
Figure 6A:
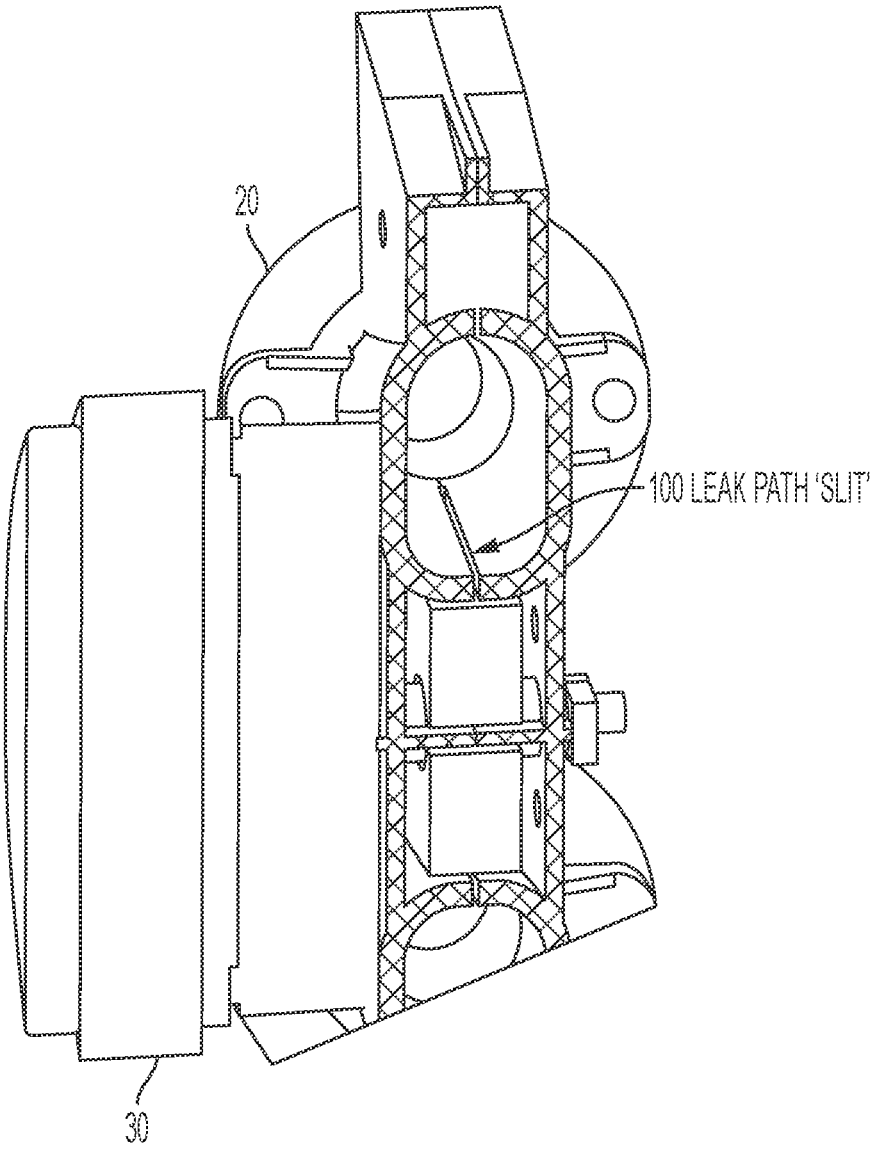
FIGS. 6A-D are interior detail views of the three-way loudspeaker shown in FIG. 5 showing the location of the slits.
Figure 6B:
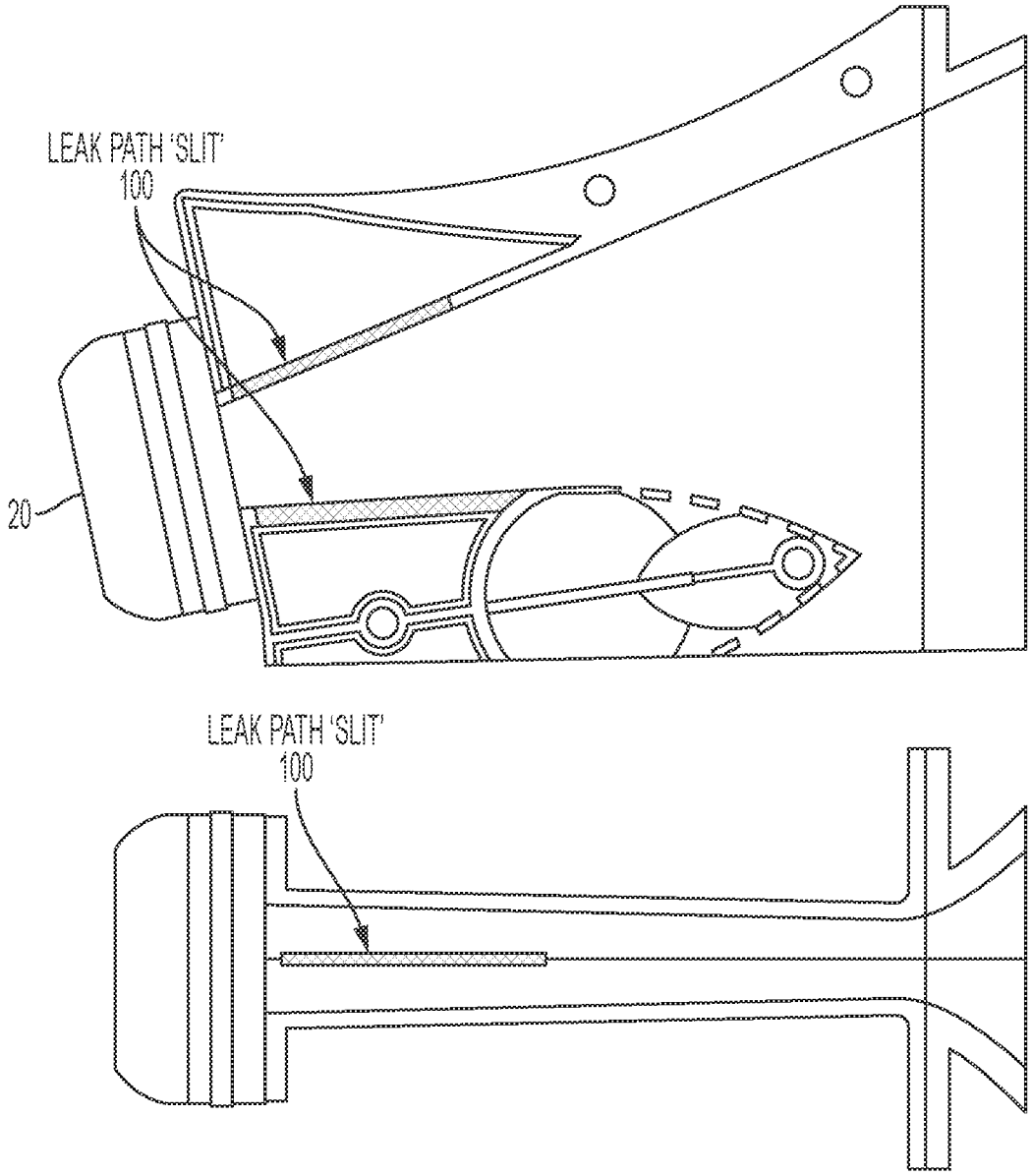
Figure 6C:
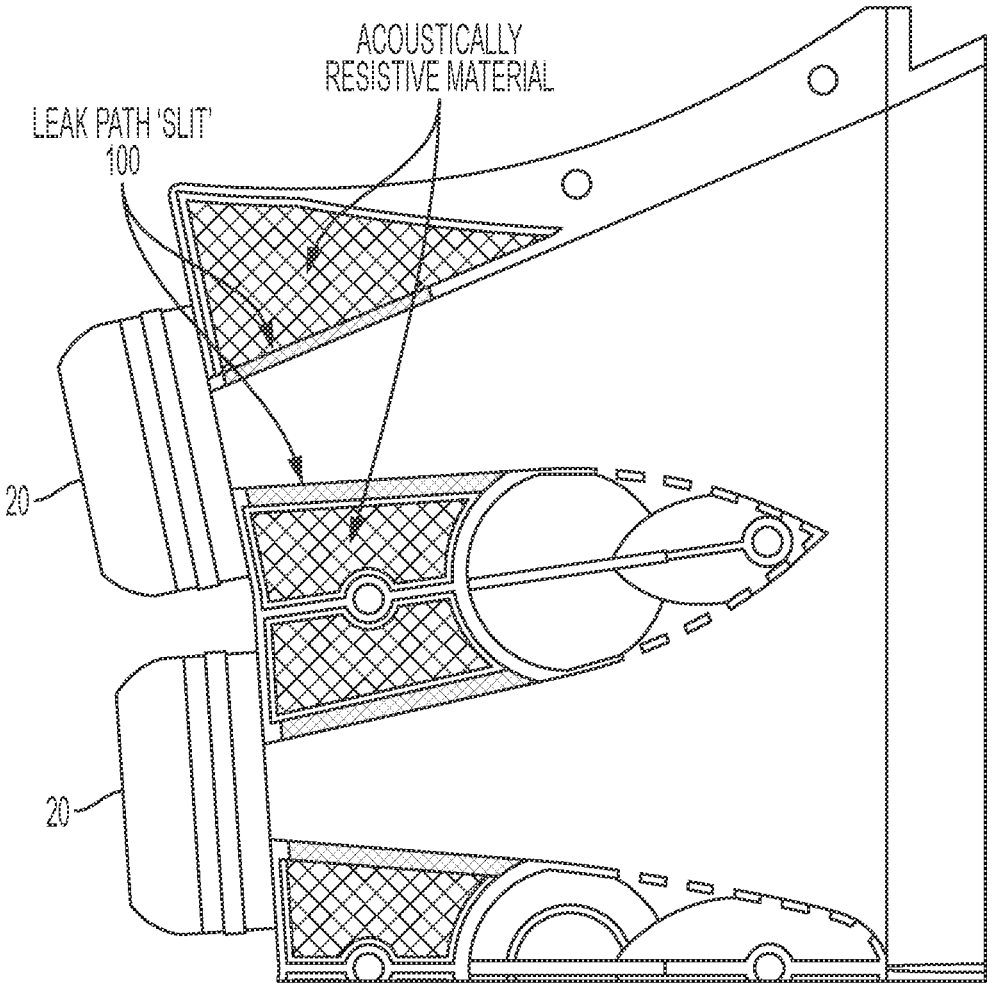
Figure 6D:
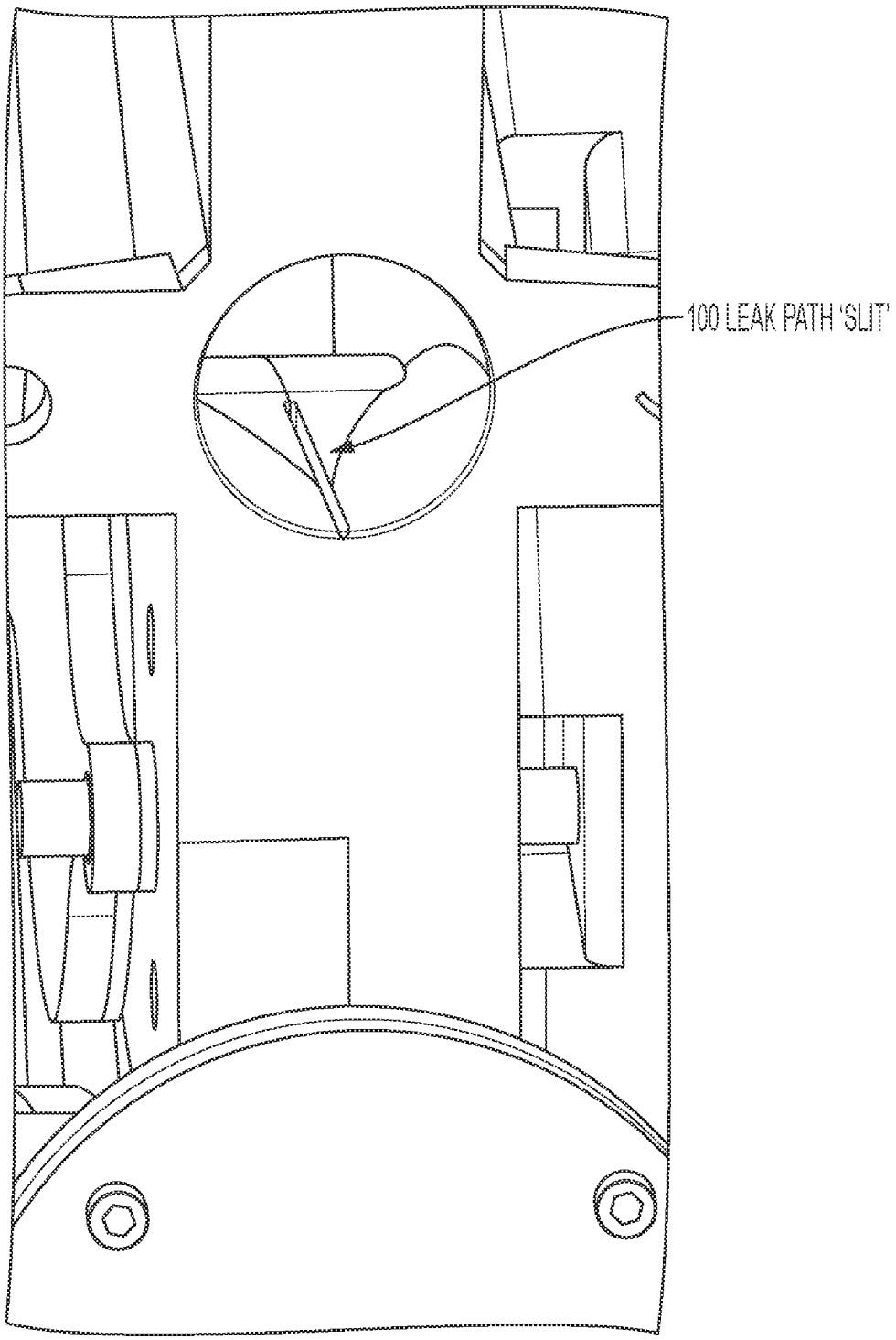

D) The HF transducers 20 are given first priority in the design since their wavelengths are the smallest and most effected by geometry. Therefore, the 4×HIP transducers 20 are coupled to the manifold 25 each with a horn "stem" designed for a strategic integration of their energy spread aver the vertical operational design coverage angle. As illustrated in FIGs. 4A and 4B, the combination of these 4× wave fronts energize the slot 70 uniformly.

E) Referring now to FIGS. 4A and 4B, the HF stems are designed with significant cross sectional growth rate and the final flare to minimize the acoustic impedance transition from the stem area to the manifold body area. This minimizes any tendency to create standing wave behavior whether from the reflected HF energy created by the acoustical transition itself or from MF secondary energy.

F) The MF energy is introduced into the manifold within the stem walls utilizing the smallest dimension and oriented over a distribution area near the slot 70 itself and away from the HF origination points. This allows the MF energy to merge—albeit chaotically—before passing through the slot and progressing down the horn. This mid-path entry does create multiple paths from the same source. The particular loudspeaker illustrated in FIGS. 5A-5C has 3×MF transducers 30 energizing 6× source entries in the manifold. All six entry points see near identical geometry and therefore exhibit the same behavior.

While design items A-E work very well, the secondary path energy related to item F is dimensionally within operational wavelengths for the MF driver 30 and therefore exhibit strong constructive and destructive interference behavior.

Figure 7A:
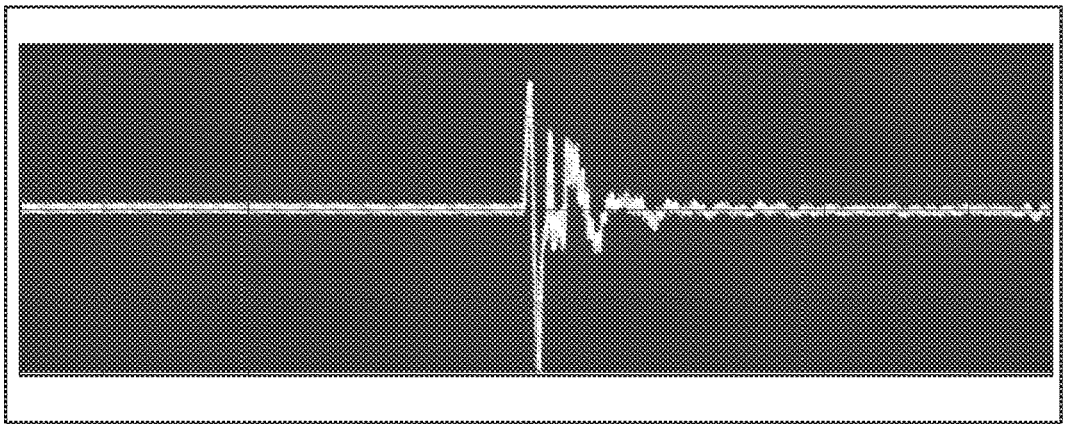
FIGS. 7A-C are graphs of the measured MF acoustic response, showing the impulse response of MF with no leak path, impulse response of MF with leak path, and frequency response of MF comparing no leak path with leak path, respectively.
Figure 7B:
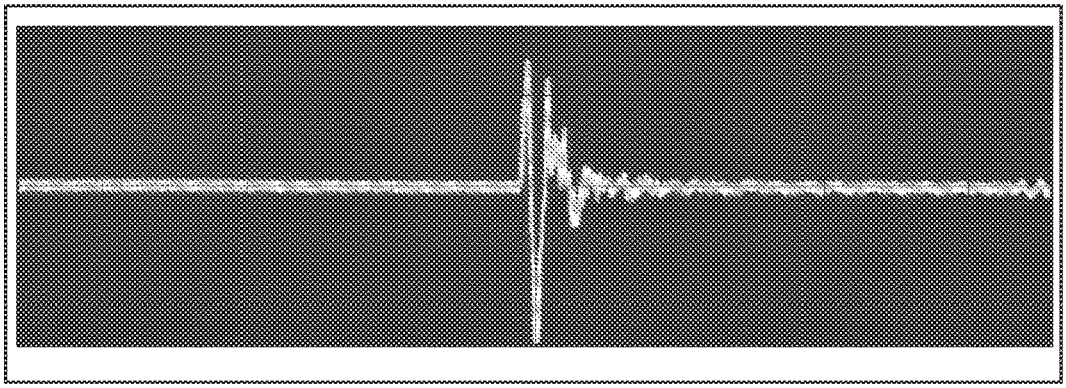
Figure 7C:
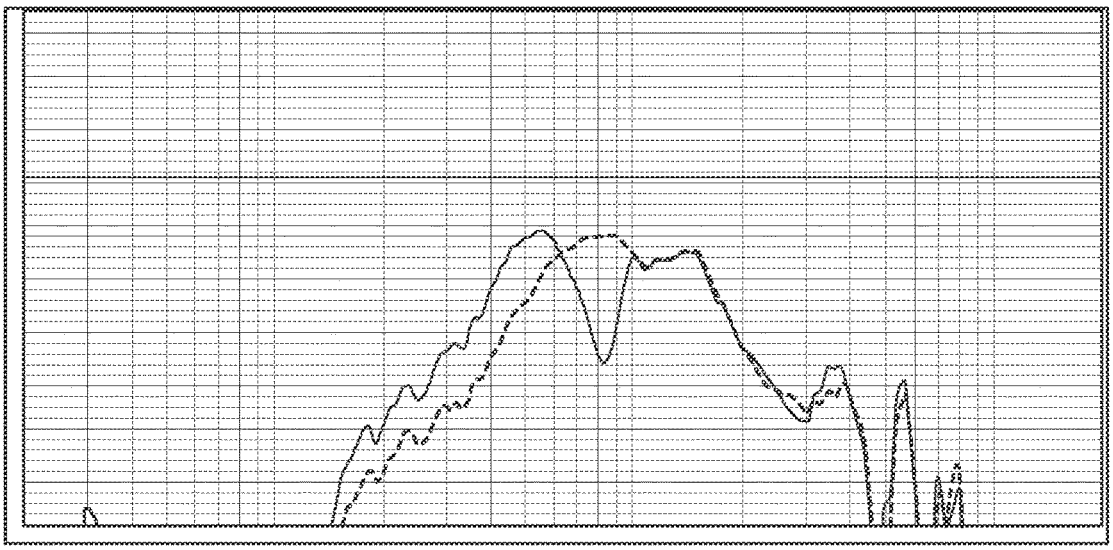

The primary mechanism for the interference is a simple first order reflection of the secondary MF energy off the HF transducer face (in this case, the transducer "face" is actually the internal back housing) which then trails the primary MF energy wave. This correlates with the path from the MF entry point, back to the HF face, and then through the slot into the horn. In contrast, the primary MF energy takes a direct path from entry point, through the slot and into the horn. The combination of the two energy arrivals presents an alteration in the Impulse Response of the MF total energy. The result can be seen in both Time and Frequency domain measurements graphed in FIGS. 7A-C.

Figure 8:
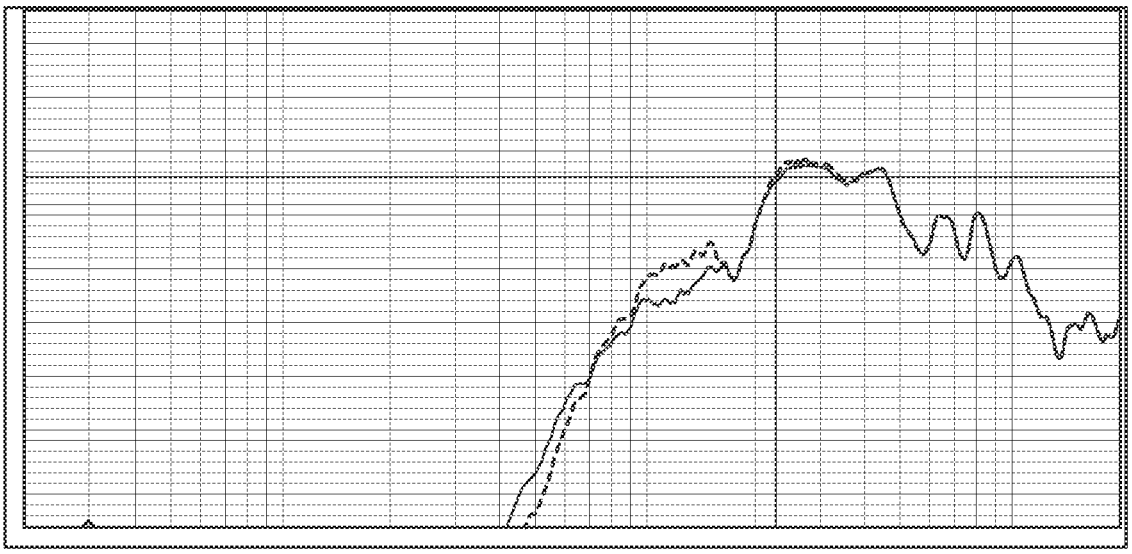
FIG. 8 is a graph of the measured HF acoustic response, showing the frequency response of HF comparing no leak path with leak path.

The present invention relates to the mitigation of the secondary energy cited above and as in the data presented. Referring now to FIG. 8, the MF energy reaching the HF face is largely captured by use of small depressurizing slit openings down the inner half of the HF stems.

Referring to FIGS. 6A-D, the openings are sized to be large enough to present a leak path for the secondary energy to mitigate out of the stem (the energy that passes through the slit 100 has no return path back into the primary radiation). The leak path opening dimensions and orientations are chosen for two primary reasons:

1) The width must be small enough to allow the HF progressive wave traveling down the stem "to see" the slits 100 as a high acoustical impedance orthogonal to the wave front—this holds true until the wavelengths are large compared to the stem dimensions.

2) The open total area of the slit must be large enough to allow a distributed leak path along the stem wall for the wavelengths that fill the stem with uniform pressure. Slits 100 work specifically well in this regard since they are not specific to any one location and in the region of high pressure from the reflected secondary wave (closest to the reflection surface).

Use of acoustically resistive material (e.g., open cell foam 90) behind the slit 100 in the "rear" acoustical domain improves the effectiveness of the leak path. The acoustical impedance of a through hole is largely reactive. A properly sized slit 100 greatly increases the acoustical resistance over a simple hole. Coupling the slit with acoustically resistive material forms an isothermal medium, greatly improving energy dissipation.

Figure 9:
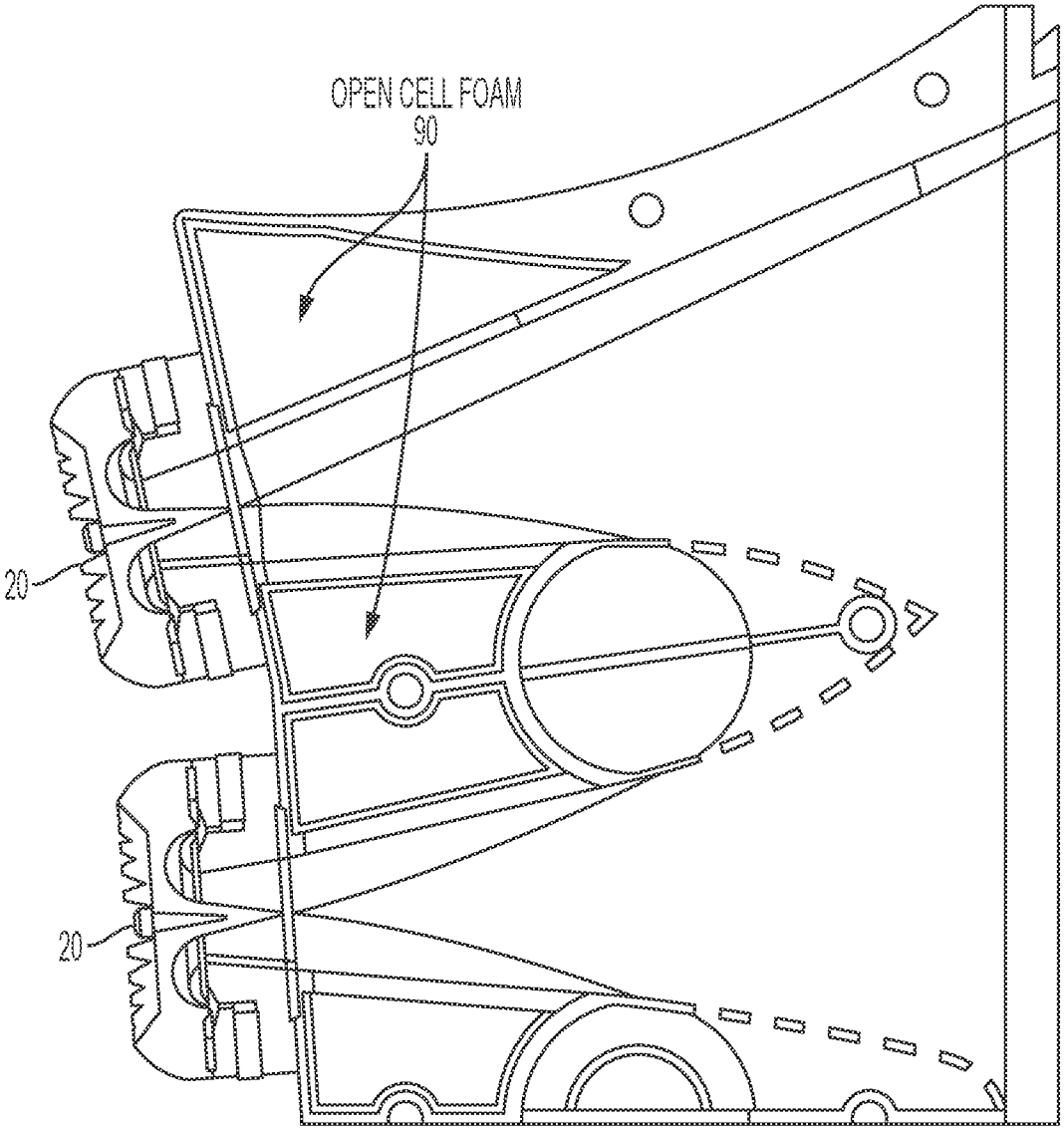
FIG. 9 is an interior detail view showing the stem of the loudspeaker illustrated in FIG. 2.

The acoustical impedance of the slit 100 is largely a reactive loading relating to the dimensions of the slit. With the foam 90 present, the area becomes more resistive by creating isothermal acoustic region greatly improving energy dissipation. The loss of energy at the lower frequencies of the MF shown in the measurements is a clear indication that the energy is migrating out—with no specific reference tuning frequency—and not returning as shown in FIG. 9.

Figure 10A:
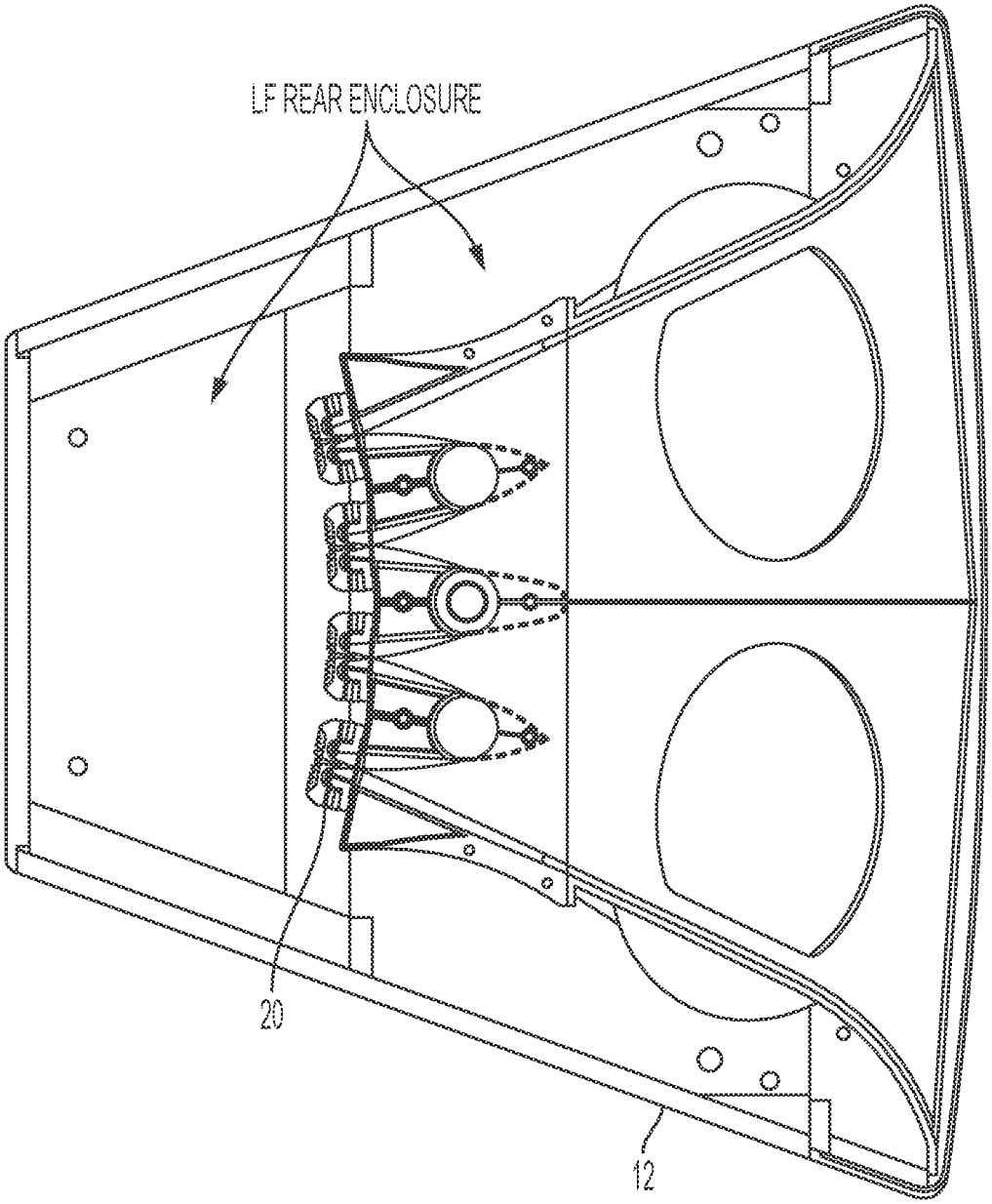
FIGS. 10A-B are interior section views showing the LF rear enclosure of the loudspeaker illustrated in FIG. 1.
Figure 10B:
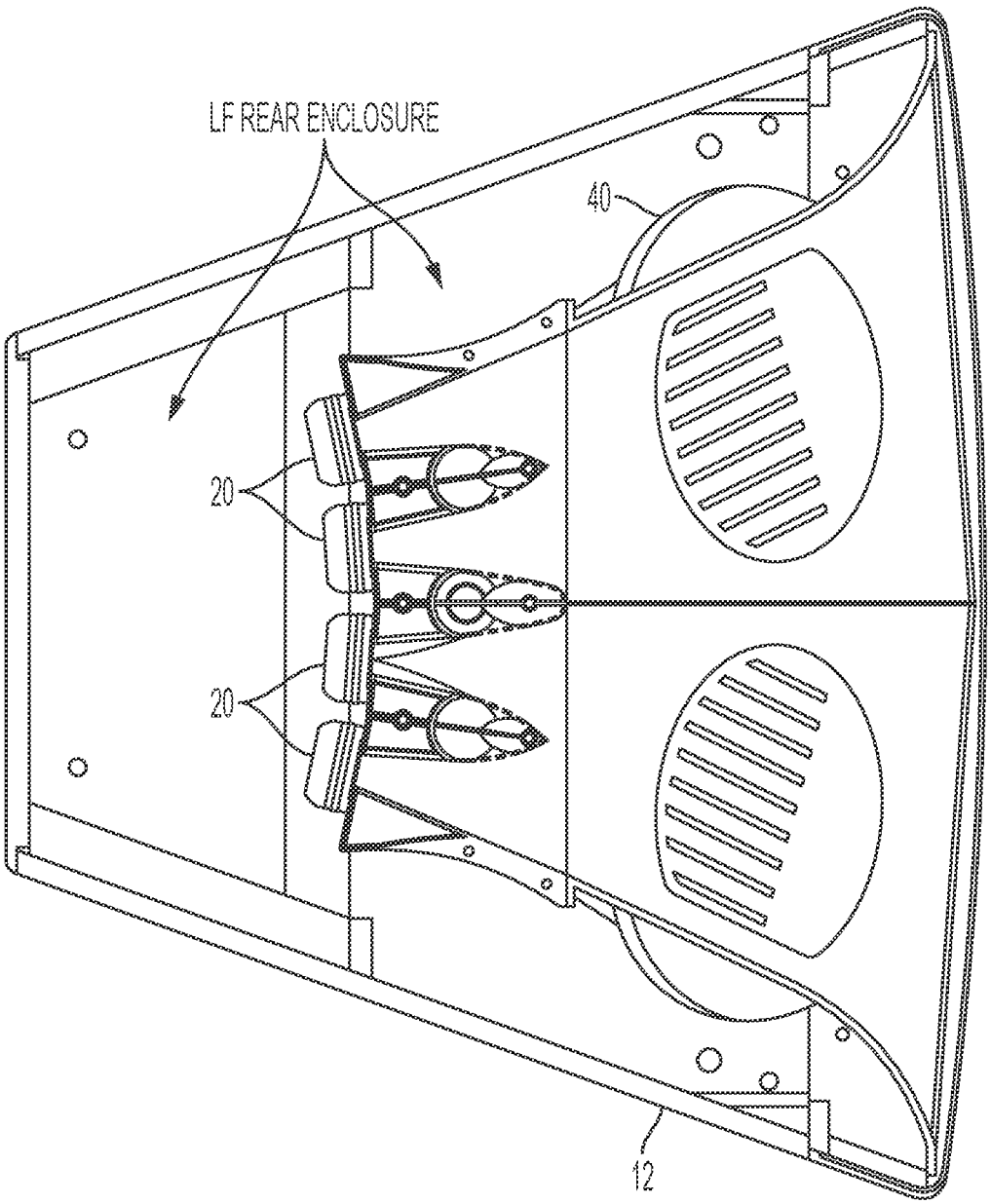

The "rear" acoustical domain in the present invention example is the inner chamber of the LF enclosure. In this case, the leak path has a dual purpose. The LF design is a sealed chamber chosen for performance, ease of manufacture and weather-resistance reasons. In such designs, it is good practice to engineer a small acoustic leak path to allow for barometric pressure fluxuations to self-adjust inside the LF chamber. This path must be highly damped to allow for a slow migration path and not present itself as a "port" to the LF energy. The present design example uses the leak path created for the MF secondary energy as the LF environmental stabilizing leak path as shown in FIGS. 10A and 10B.

Similar examples in the prior art cite strong standing wave behavior (pipe organ type resonances). One cited solution to this problem is a Helmholtz resonator (tuned cavity). The present invention utilizes a different method and relates to a different problem. In the presented design example, standing wave phenomenon is not the dominant behavior.

In one embodiment, an improvement of the energy distribution from a multi-way loudspeaker into free space is presented. MF energy is reduced through the use of small depressurizing slit openings down the inner half of the HF stems. The openings are sized to be large enough to present a leak path for the secondary energy to migrate out of the stem with no return path.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

What is claimed is:

1. A method, comprising:

reducing secondary path mid-frequency energy via small depressurizing slit openings down an inner half of a high-frequency stem of a multiple frequency loudspeaker.

2. The method of claim 1 wherein the openings are sized to be large enough to present a secondary leak path for rearward traveling waves of a high-frequency transducer to migrate out of the high-frequency stem thereby minimizing its ability to return into the primary path.

3. The method of claim 2 wherein the width of each slit openings is small enough to present a high acoustical impedance orthogonal to high-frequency progressive wave front traveling down the high-frequency stem.

4. A multiple-frequency loudspeaker having at least one mid-frequency transducer and at least one high-frequency transducer driving a single unified horn, said loudspeaker comprising:

a. a horn mouth;

b. a horn stem connected to said horn mouth;

c. said at least one high-frequency transducer affixed proximate to said horn stem;

d. said at least one mid-frequency transducer fixed proximate to said at least one high frequency transducer; and e. at least one depressurizing slit positioned in the horn stem.

5. The multiple-frequency loudspeaker of claim 4 wherein the size of the slit is chosen to be large enough to present a leak path for secondary energy to migrate out of the stem with no return path.

6. The multiple-frequency loudspeaker of claim 5 further comprising at least one low-frequency transducer positioned closer to the mouth of said horn.

* * * * *